United States Patent [19]

Pradelle

[11] Patent Number: 4,871,214

[45] Date of Patent: Oct. 3, 1989

[54] CHEEKING DEVICE, PARTICULARLY FOR THE HANGING ROOF IN MINES, UNDERGROUND WORKING POINTS, OR HEADING AND SIMILAR

[75] Inventor: Bernard Pradelle, Haute Vienne, France

[73] Assignee: Sories, France

[21] Appl. No.: 230,243

[22] Filed: Aug. 5, 1988

[30] Foreign Application Priority Data

Aug. 6, 1987 [FR] France ..... 87 11384

[51] Int. Cl.[4] ..... E21C 3/04

[52] U.S. Cl. ..... 299/69; 125/43; 173/90; 299/94

[58] Field of Search ..... 299/14, 69, 94; 175/414, 416; 125/40, 43; 104/13, 14; 404/133; 173/39, 90, 91

[56] References Cited

U.S. PATENT DOCUMENTS 2,004,083 6/1935 Scott ..... 404/133
3,036,482 5/1962 Kemworthy et al. ..... 173/90
3,857,448 12/1974 Lines ..... 404/133 X

FOREIGN PATENT DOCUMENTS 926614 5/1973 Canada ..... 299/69

*Primary Examiner*—IV Massie
*Assistant Examiner*—David J. Bagnell
*Attorney, Agent, or Firm*—Arnold S. Weintraub

[57] ABSTRACT

The present invention is a device for removing boulders loosened by an explosion, from the hanging roof of a mining gallery. The device is a pole which supports a pneumatic hammer and a striking head at one end thereof and a gripping handle at its opposite end. The handle has a trigger mechanism for remote control of the pneumatic hammer. The inner section of the striking head is a formation of hollow, honeycombed cells, for reducing the weight of the striking head.

7 Claims, 3 Drawing Sheets

CHEEKING DEVICE, PARTICULARLY FOR THE HANGING ROOF IN MINES, UNDERGROUND WORKING POINTS, OR HEADING AND SIMILAR

The present invention concerns a cheeking device which is intended for the use at working points, especially an underground mine or an underground heading.

In order to gain access to a number of underground working points or for the purpose of exploiting metalliferous mines, the working of rocks necessitates the use of explosives. Following the blast, rocks fall and need to be removed in order to facilitate the advance heading. Moreover, the rock boulders which were fragmented or made brittle by the explosion need to be loosened or broken up, following the blast, especially those which are suspended from the hanging roof, i.e. above the floor of the gallery. The boulders do not fall under their own weight. Some remaining rock deposits on the roof are loose fragments. In any such case, the boulders constitute a danger in that there is a risk of their falling at the wrong time in the course of continuing the mining of the heading. In order to reduce the risk it is therefore a known procedure to "cheek off" the rock wall, i.e. to explore it by manually tapping the wall with a hammer, in order to loosen the suspended boulders.

This known procedure entails a manual cutting which does not permit the safe loosening of boulders which are difficult to extract.

The present invention has as its objective the elimination of these disadvantages by providing a cheeking device which permits the rapid and efficient cheeking of a rock wall, especially after an explosive blast.

Such a cheeking device according to the invention is characterized in that it consists of a combination of a pneumatic hammer;

a pole which at its top end supports the pneumatic hammer whereas its bottom end consists of a gripping handle and also of a trigger mechanism for the remote control of the pneumatic hammer;

at the free end of the pneumatic hammer a striking piece with a shank which is topped by a percussion bit, the weight of which is reduced by means of inner, hollow honeycomb cells.

According to another characteristic of the invention the percussion bit forms a substantially oblate ellipsoid of revolution.

According to another characteristic of the invention the honeycomb cells have a substantially tapered shape and are hollowed radially from the axis of the revolution of the ellipsoid, whereby such a geometric axis corresponds to the longitudinal axis of the tool and the pneumatic hammer.

According to yet another characteristic of the invention the geometric axis of each of the tapered honeycomb cells is arranged radially, substantially on the equatorial plane of the oblate ellipsoid.

It is a further characteristic of the invention that the shape of the percussion bit allows for its optimum contact with the rock surface, and a concentration of the maximum percussion energy for a reduction of the mechanical inertia in the area which is not supported by the maximum percussion force.

The examples given in the following drawings are by no means limiting and permit at best an understanding of the characteristics of the invention and the advantages which are inherent in its practical application.

Figure 1:
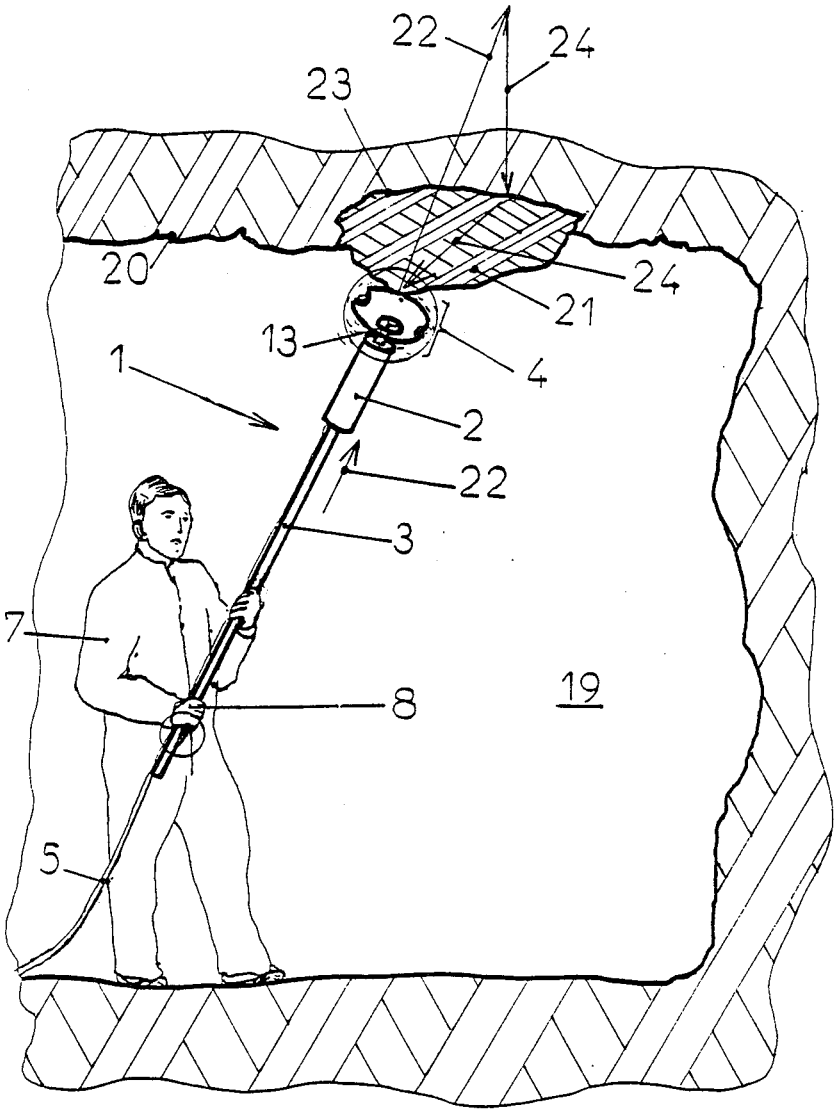
FIG. 1 shows a device according to the invention in the process of its application, for cheeking the hanging the gallery of a mine.
Figure 2:
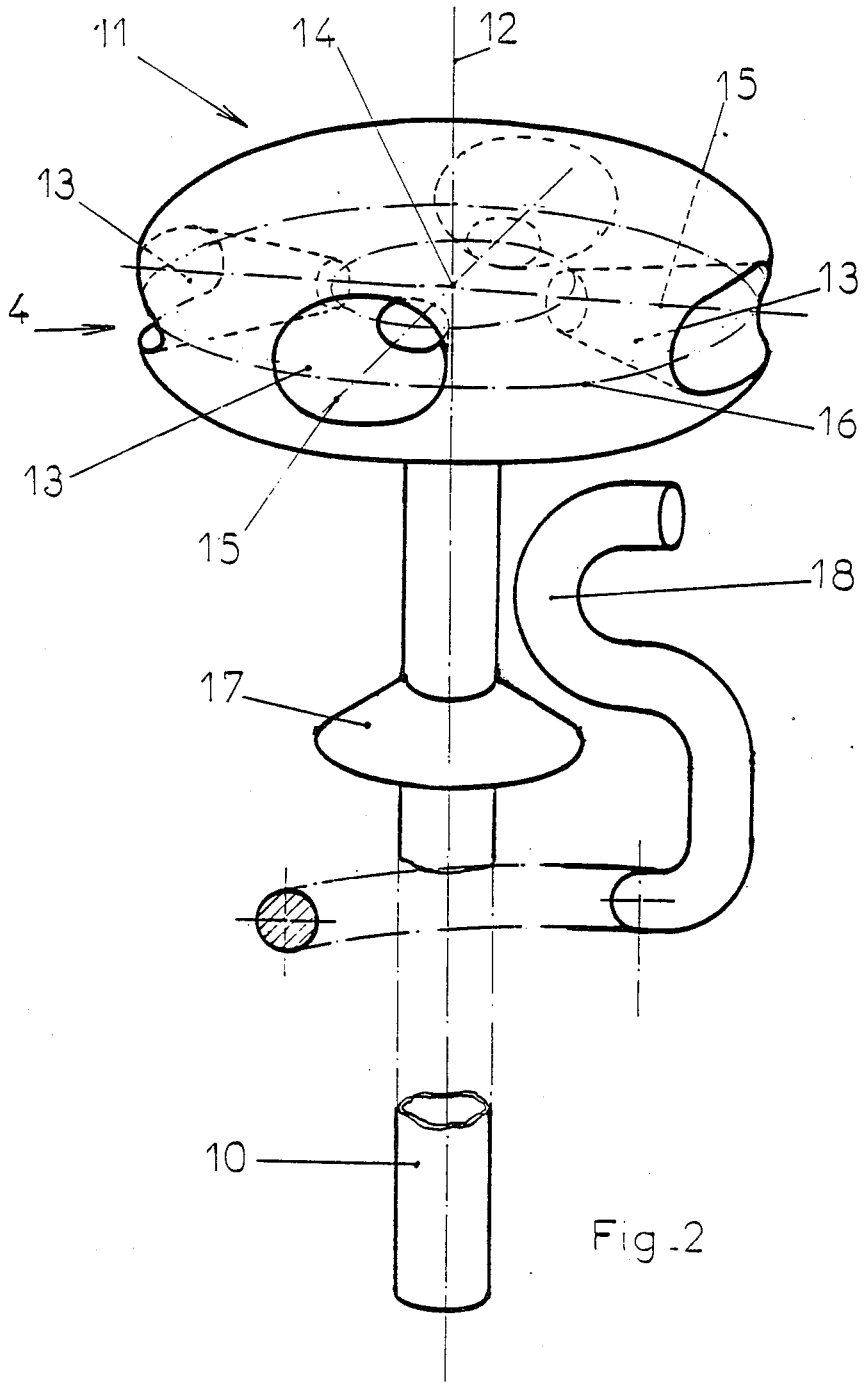
FIG. 2 shows details of assembling the striking piece at the end of the hammer.
Figure 3:
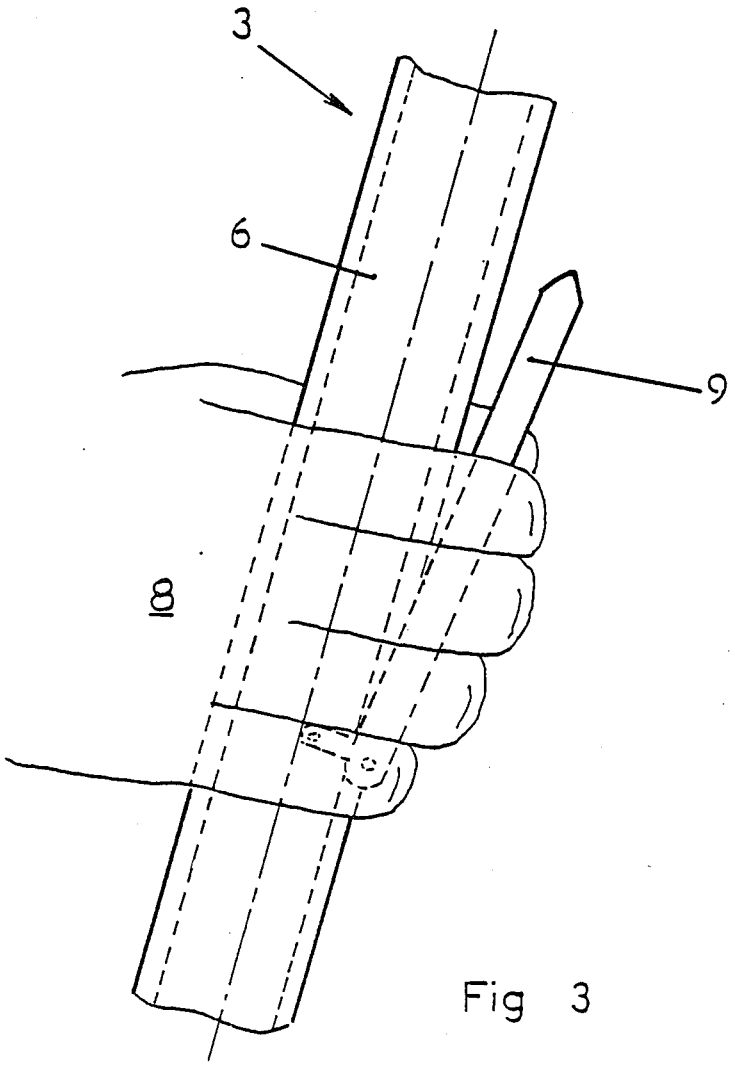
FIG. 3 shows the trigger mechanism for the remote control at the lower end of the pole.

The cheeking device 1 shown in the drawings consists of a combination of a pneumatic hammer 2, a supporting pole 3, a striking piece 4.

The pole 3 may have a length in the order of two to three metres. It has a compressed air supply which is provided via a flexible hose 5. Furthermore, the lower part of the pole 3 is equipped with a handle 6 which the user 7 grasps with one hand 8. Also, with his hand 8 he is able to activate a trigger mechanism 9, thus remote-controlling the function of the pneumatic hammer 2.

At its end, it receives in the usual manner the shank 10 of the percussion tool. In the case of the invention, the percussion tool consists of the piece 4, whereby the shank 10 is supported on a wider head 11. The latter is made of metal in one piece with the shank 10. This head 11 normally forms an oblate ellipsoid of revolution around the geometric axis 12 which is shared by the head 11 and the shank 10.

The weight of the head 11 is reduced by providing it with honeycomb cells 13. Each of these is more or less tapered, converging at the centre 14. The longitudinal axis 15 of each of these honeycomb cells 13 is more or less situated on the equatorial plane 16 of the ellipsoid of revolution. Finally, the shank 10 is preferably equipped, at mid-length, with a collar flange, 17 of a known type, provided for cooperating with an offset spring 18 which normally extends beyond the pneumatic hammer 2.

The following describes the functioning:

After the blast of an explosion in a mine gallery 19 (FIG. 1), certain parts of the hanging roof 20 are made brittle by the explosion but do not fall under their own weight. There may also be a rock boulder 21 which may be loosened from the hanging roof 20. It is thus necessary to "cheek off" the hanging roof 20 prior to opening the gallery 19 for further work to be carried out without risk.

It will be obvious that the invention permits the user to cheek off with maximum efficiency, whereby this very simple operation is a perfectly natural action. In effect, it is sufficient for him to push the pole 3 more or less forcefully against the boulder 21, thereby varying the frequency and the amplitude of impacts exercised by the head 4. These impact waves generated by the pneumatic hammer combine if necessary to an "aggregate of waves" which reenter in resonance with the generator, which then causes the dislodging of the boulders. One will notice that these advantages may be obtained in a large variety of rock, especially if the percussion bit 4 has a structure of honeycomb cells.

The cheeking effected with impact waves consists of generating an energy of variable amplitude and frequency which at the point 23 forms a resonant aggregate of waves which intensifies tremendously with the accumulation of energy.

The increase of the amplitude of a vibration (or of impact waves) at this point is thus the result of a circuit which is in resonance with the period or the frequency imposed by pneumatic hammer.

Furthermore, the impact wave 22 emitted by the hammer 2 combines with the wave 24 which is reflected back and has the same frequency. The energy of the impact wave emitted at point 23 becomes resonant with the hammer 2, thus causing the loosening of the boulder 21.

I claim:

1. A cheeking device for a hanging roof of an underground mine working point, comprising:

(a) a pneumatic hammer, the pneumatic hammer comprising a first end connected to a pole and a second end which attaches to a striking head, the striking head comprising:

(1) a shank; and (2) a percussion bit, the bit being attached to the shank, the bit comprising: an inner section and an outer section, the inner section having a plurality of hollow, honeycombed cells;

(b) the pole having a top end and a bottom end, the top end supporting the pneumatic hammer and the bottom end comprising a gripping handle; and (c) a trigger mechanism connected to the pole for remote control of the pneumatic hammer.

2. The device of claim 1 wherein: the hollow honeycombed cells of the bit are substantially tapered and arranged radially around the axis of revolution of the head, and being open to said outer section, the cells having a geometric axis which corresponds to the longitudinal axis of the device.

3. The device of claim 2 wherein the honeycombed cells of the bit are arranged so that the geometric axis of each of the tapered honeycombed cells is arranged radially, substantially on the equatorial plane of the oblate ellipsoid of the head.

4. The device of claim 1 which further comprises a means for emitting a vibratory wave, wherein the vibratory wave which is emitted from the pneumatic hammer, is reflected back from a rock to resonate and loosen the rock.

5. A cheeking device for a hanging roof of an underground mine working point, comprising:

(a) a pneumatic hammer, the pneumatic hammer comprising a first end connected to a pole and a second end which attaches to a striking head, the striking head comprising:

(1) a shank; and (2) a percussion bit, the bit being attached to the shank and the bit comprising an inner section and an outer section, the inner section comprising a plurality of hollow, honeycombed cells, the cells being substantially tapered and arranged radially around the axis of revolution of the head, and being open to said outer section, the cells having a geometric axis which corresponds to the longitudinal axis of the device;

(b) the pole having a top end and a bottom end, the top end supporting the pneumatic hammer and the bottom end comprising a gripping handle, and (c) a trigger mechanism connected to the pole for remote operation of the pneumatic hammer.

6. The device of claim 5 wherein the honeycombed cells of the bit are arranged so that the geometric axis of each of the tapered, honeycombed cells is arranged radially, substantially on the equatorial plane of the oblate, ellipsoid of the head.

7. The device of claim 5 which further comprises a means for emitting a vibratory wave, wherein the vibratory wave which is emitted from the pneumatic hammer, is reflected back from a rock to resonate and loosen the rock.

* * * * *